US010981740B2

(12) United States Patent
Downing et al.

(10) Patent No.: US 10,981,740 B2
(45) Date of Patent: Apr. 20, 2021

(54) MEDIA REGISTRATION SYSTEM WITH LATERAL REGISTRATION

(71) Applicant: HEWLETT-PACKARD DEVELOPMENT COMPANY, L.P., Houston, TX (US)

(72) Inventors: Elliott Downing, Vancouver, WA (US); Cristopher Royce Jansson, Vancouver, WA (US); Robert Yraceburu, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/176,620

(22) Filed: Oct. 31, 2018

(65) Prior Publication Data

US 2020/0130974 A1 Apr. 30, 2020

(51) Int. Cl.
*B65H 9/12* (2006.01)
*B65H 9/00* (2006.01)

(52) U.S. Cl.
CPC ..... *B65H 9/12* (2013.01); *B65H 9/004* (2013.01); *B65H 2404/2532* (2013.01)

(58) Field of Classification Search
CPC ..... B65H 9/12; B65H 9/002; B65H 5/021; B65H 5/023; B65H 5/025; B65H 5/026; B65H 47/2445
See application file for complete search history.

(56) References Cited

U.S. PATENT DOCUMENTS 4,244,461 A * 1/1981 Fischer ..... B65H 5/021 198/456
6,851,250 B2 * 2/2005 Whitby ..... B65B 57/14 198/456
7,472,905 B2 * 1/2009 Inoue ..... B65H 9/006 271/227
8,454,012 B2 6/2013 Obuchi et al.
8,817,277 B2 * 8/2014 Matsushima ..... B65H 7/08 271/171
8,882,106 B2 11/2014 Maenishi et al.
8,944,432 B2 * 2/2015 Karikusa ..... B65H 9/00 271/246
9,809,408 B2 11/2017 Maenishi et al.
2005/0035536 A1 * 2/2005 Suga ..... B65H 9/16 271/226
2018/0265318 A1 * 9/2018 Langhuber ..... G07D 11/40

FOREIGN PATENT DOCUMENTS

WO 2017099731 6/2017

* cited by examiner

*Primary Examiner* — Patrick Cicchino
(74) *Attorney, Agent, or Firm* — Dicke Billig & Czaja PLLC

(57) ABSTRACT

A media registration system including a track to transport media in a transport direction from an intake end to a registration end, and a pivot shaft. A translator to register media in a lateral direction to the transport direction includes a translation element operatively coupled to the track and moveable along a translation axis in the lateral direction, and a driver to drive the translation element a translation distance along the translation axis to rotate the track about the pivot shaft to move the registration end a selected registration distance in the lateral direction, the translation distance proportional to the selected registration distance.

8 Claims, 5 Drawing Sheets

MEDIA REGISTRATION SYSTEM WITH LATERAL REGISTRATION

BACKGROUND

Post-imaging operations for sheets of imaging media, such as from a printer, for instance, include aligning, stacking, and stapling sheets of media, for example.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

Upon discharge from an image forming apparatus, such as a printer, for example, media conveying systems may perform various post-imaging operations such as aligning, stacking, and stapling sheets of imaging media, for example. Aligning and stacking of sheets of media may be sometimes be referred to as "registration", with media output systems sometimes being referred to as media registration systems.

Figure 1:
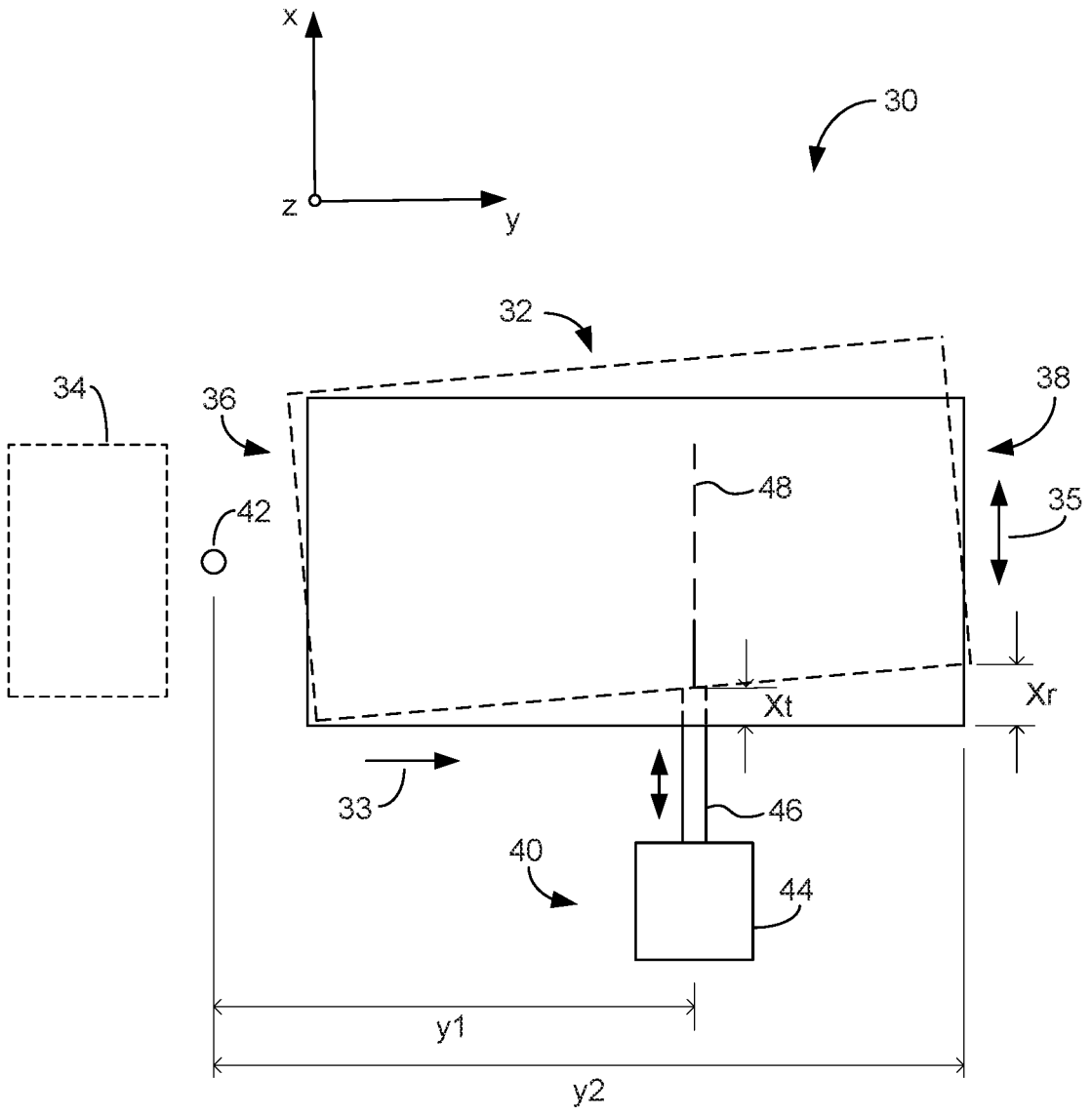
FIG. 1 is a block and schematic diagram illustrating a media registration system, according to one example.

FIG. 1 is a block and schematic diagram generally illustrating a top view of a media registration system 30, according to one example of the present disclosure. Media registration system 30 includes a transport track 32 to receive sheets of media 34 at an intake end 36, such as from an image forming apparatus (e.g., a printer), and to transport sheets of media 34 along transport track 32 in a transport direction 33 (illustrated as a y-direction in FIG. 1) to an output or registration end 38.

In one example, media registration system 30 includes a translator 40 to rotate transport track 32 about a pivot 42 to a adjust a position of registration end 38 in a direction 35 lateral to transport direction 33 to provide registration or alignment of edges of sheets of media 34 in the lateral direction 35 at registration end 38 to form a media stack, such as for stapling operations, for example. In one example, lateral direction 35 is orthogonal to transport direction 33 (such as an x-direction in FIG. 1). In examples, as illustrated, pivot 42 enables rotation of transport track 32 in the x-y plane. In one case pivot 42 is a pivot shaft extending orthogonally to transport and lateral directions 33 and 35, such as a z-direction (into/out of page in FIG. 1). In one example, pivot 42 is disposed proximate to intake end 36. In one example, pivot 42 is disposed at a corner of transport track 32 at intake end 36.

In one example, translator 40 includes a driver 44 and a translation element 46 operatively coupled to transport track 32, where driver 44 drives translation element 46 to rotate transport track 32 about pivot 42. According to examples, driver 44 drives translation element 46 along a translation axis 48 extending in lateral direction 35 to rotate transport track 32 about pivot 42. In one example, driver 44 drives translation element 46 by a translation distance Xt to move registration end 38 of transport track 32 by a registration distance Xr in lateral direction 35.

According to examples, translation axis 48 is disposed at a location other than at registration end 38 of the transport track 32, such that translation axis 48 and registration end 38 are at different distances in transport direction 33 from pivot 42. In one example, as illustrated, translation axis 48 is at a first distance, y1, in transport direction 33 from pivot 42, and registration end 38 is at a second distance, y2, in transport direction 33 from pivot 42. With translation element 46 and registration end 38 at different distances in transport direction 33 from pivot 42, due to angular movement of transport track 32 when rotated about pivot 42, movement of translation element 46 by a translation distance, Xt, along translation axis 48 results in movement of registration end 38 by a registration distance Xr that is different from translation distance, Xt. In one example, translation distance, Xt, is proportional to registration distance, Xr, but is not a one-to-one relationship.

If not accounted for, the proportional relationship between Xt and Xr may result in misalignment between edges of sheets of media 34 in lateral direction 35 at registration end 38 of transport track 32, with the mismatch being greater the larger the difference between distances y1 and y2 and the greater the translation distance Xt. In one example, to compensate for such mismatch, in order to move registration end 38 of transport track 32 by a selected registration distance, Xr, driver 44 drives translation element 46 along translation axis 48 by a translation distance, Xt, equal to the selected registration distance, Xr, multiplied by an adjustment factor, Af (i.e., $Xt=Af \cdot Xr$). In one example, adjustment factor, Af, is equal to a ratio of the first distance, y1, to the second distance, y2 (i.e., $Af=y1/y2$), such that $Xt=(y1/y2) \cdot Xr$.

By driving translation element 46 along translation axis 48 by a translation distance, Xt, that is equal to product of the selected registration distance, Xr, and the adjustment factor, Af, translator 40 accounts for the mismatch in travel distances between Xt and Xr resulting from the angular motion of transport track 32 about pivot 42 so that media registration system 30 is able to accurately align edges of sheets of print media 34 in lateral direction 35.

Figure 2:
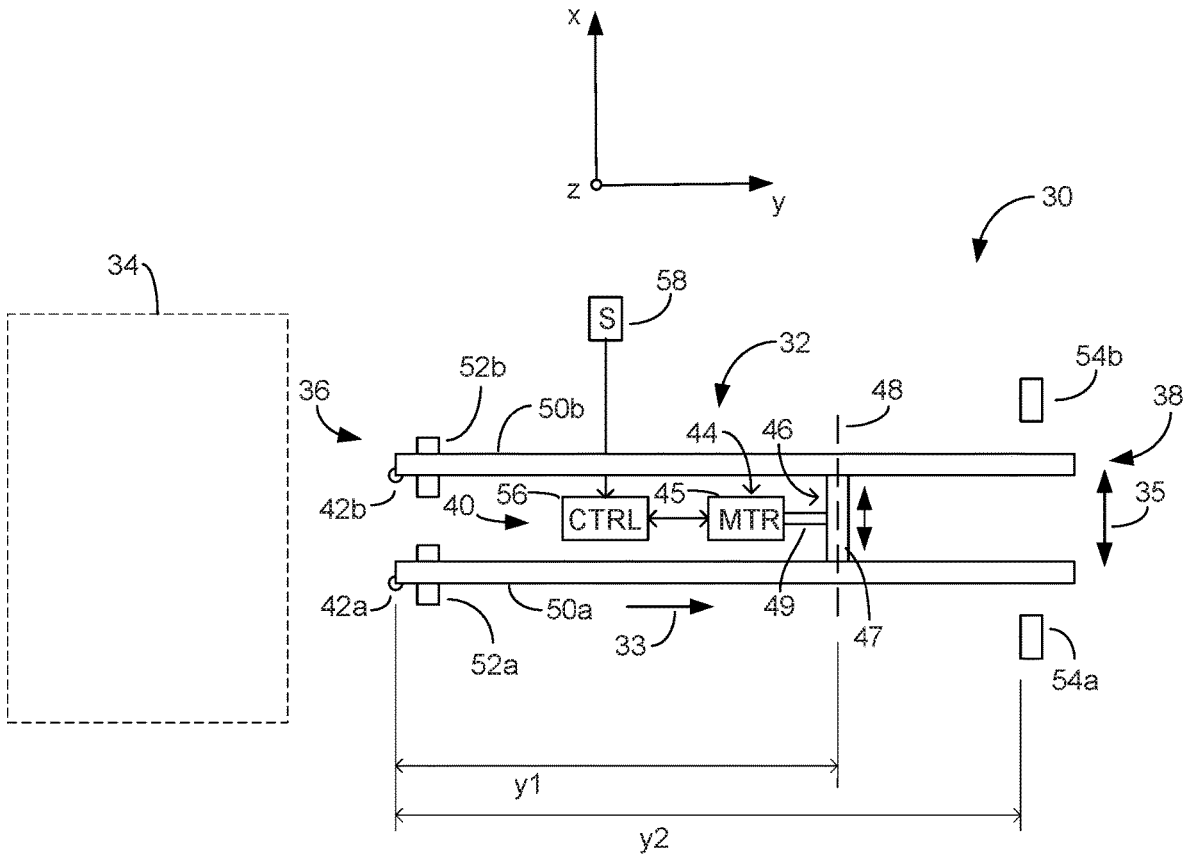
FIG. 2 is a block and schematic diagram illustrating a media registration system, according to one example.

FIG. 2 is a block and schematic diagram illustrating a top view of media registration system 30, according to one example, where transport track 32 includes a pair of parallel puller tracks 50*a* and 50*b*, where each puller track is rotatable around a corresponding pivot, such as illustrated by pivots 42*a* and 42*b*. In one example, each puller track, 50*a* and 50*b*, includes a puller clamp, such as puller clamps 52*a* and 52*b*, which are driven along puller tracks 50*a* and 50*b*, such as by a continuous belt, for example (not illustrated). In one example, each puller track may include more than one puller clamp. In examples, as described in greater detail below, puller clamps 52*a* and 52*b* open and close as they travel along puller tracks 50*a* and 50*b*, with puller clamps 52*a* and 52*b* opening to receive a sheet of imaging media 34 at input end 36 of transport track 32 and then closing to capture and transport a received sheet of imaging media 34 along puller tracks 50*a* and 50*b* to registration end 38. Upon reaching registration end 38, puller clamps 52*a* and 52*b* open to release the sheet of imaging media 34 (to a support surface, such as an output tray, for instance) and return to intake end 36.

In one example, media registration system 30 includes a y-registration element, such as y-registration elements 54*a* and 54*b*, at registration end 38. As described in greater detail below, y-registration elements 54*a* and 54*b* provide surfaces which contact a leading edges of sheets of imaging media so as to provide registration (i.e., alignment) in transport direction 33 of edges of sheets of imaging media 34, such as leading edges of the sheets of media 34, as they are transported along puller tracks 50*a* and 50*b*.

In one example, puller clamps 52*a* and 52*b* each include a nip to secure sheet of imaging media 34 thereto. In one example, each nip is formed by a pair of biased rollers (not illustrated). According to such example, as puller clamps 52*a* and 52*b* pull sheet 34 along tracks 50*a* and 50*b*, a leading edge of sheet 34 contacts and is registered in transport direction 33 by y-registration elements 54*a* and 54*b*. As the leading edge of sheet 34 contacts and is registered by y-registration elements 54*a* and 54*b*, sheet 34 in prevented from movement in transport direction 33. As puller clamps 52*a* and 52*b* continue to move along tracks 50*a* and 50*b* in transport direction 33, sheet 34 is "pushed" from the nips of puller clamps 52*a* and 52*b* by y-registration elements 54*a* and 54*b*. Upon release from puller clamps 52*a* and 52*b*, sheet 34 is maintained on a support surface below puller tracks 50*a* and 50*b*, such as an output tray (not illustrated), for example. In this regard, it is noted that, in one example, when transporting a sheet of imaging media 34, puller clamps 52*a* and 52*b* move in transport direction 33 along a lower portion of puller tracks 50*a* and 50*b*, and after releasing sheet 34 return to intake end 36 along an upper portion of puller tracks 50*a* and 50*b* in a direction opposite to transport direction 33.

In one example, translation element 46 is operatively coupled to puller tracks 50*a* and 50*b* and is driven along translation axis 48 to respectively rotate puller tracks 50*a* and 50*b* about corresponding pivots 42*a* and 42*b* so as to provide alignment of sheets of imaging media 34 in lateral direction 35 at registration end 38. In one example, driver 44 may be a motor 45 (e.g., a DC brushed motor) and translation element 46 may implemented as a rack and pinion system, having a rack 47 operatively coupled to puller tracks 50*a* and 50*b*, and a pinion 49 driven by motor 45 to drive the rack 47 back and forth along translation axis 48 to respectively rotate puller tracks 50*a* and 50*b* about pivots 42*a* and 42*b*. It is noted that in other examples, translator 40 may be implemented using other types of actuating systems, including linear actuators, for example.

In one example, translator 40 (which may also sometimes be referred to as an x-registration system) further includes a controller 56 and a sensor 58. As described in greater detail below, according to examples, as puller clamps 52*a* and 52*b* pull sheets of imaging media 34 along puller tracks 50*a* and 50*b*, sensor 58 measures a position of sheets of imaging media 34 in lateral direction 35. Based on the measured lateral position and employing the adjustment factor, Af, described above, for each sheet of imaging media 34, controller 56, via motor 45 (e.g., a DC brushed motor) and translation element 46 (e.g., rack and pinion gears 47/49), rotates puller tracks 50*a* and 50*b* about pivots 42*a* and 42*b* to register edges of sheets of imaging media 34 in lateral direction 35.

Figure 3A:
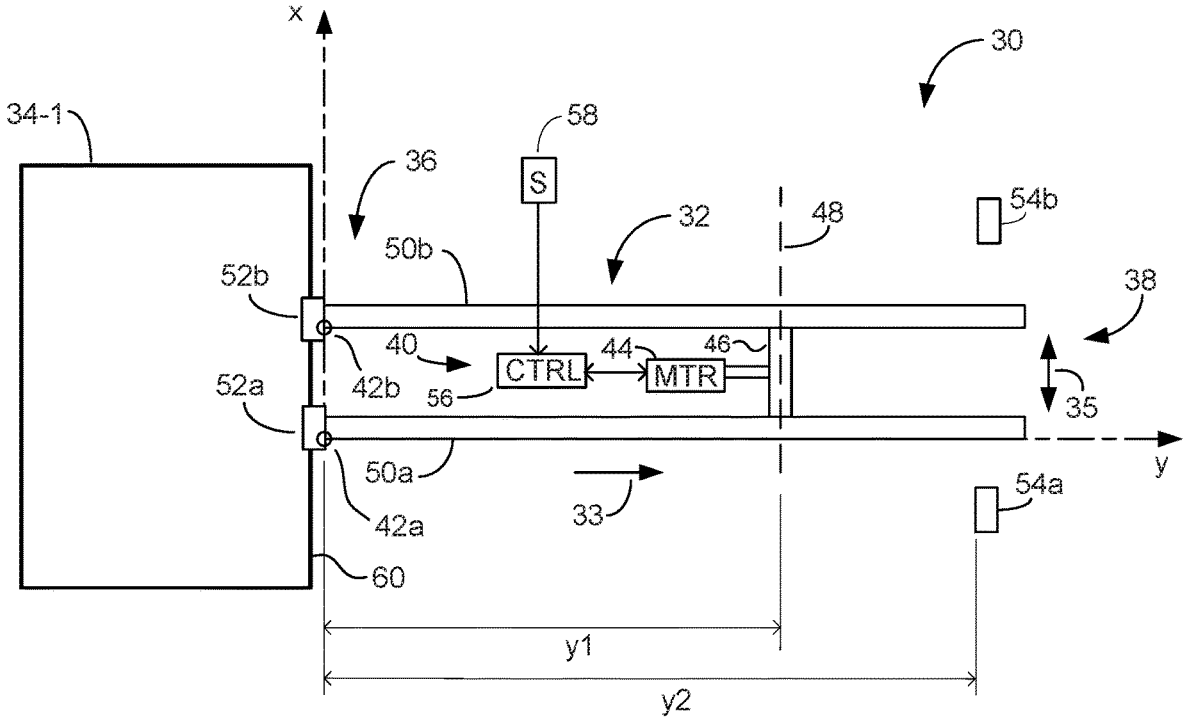
FIG. 3A is a block and schematic diagram illustrating a media registration system, according to one example.
Figure 3B:
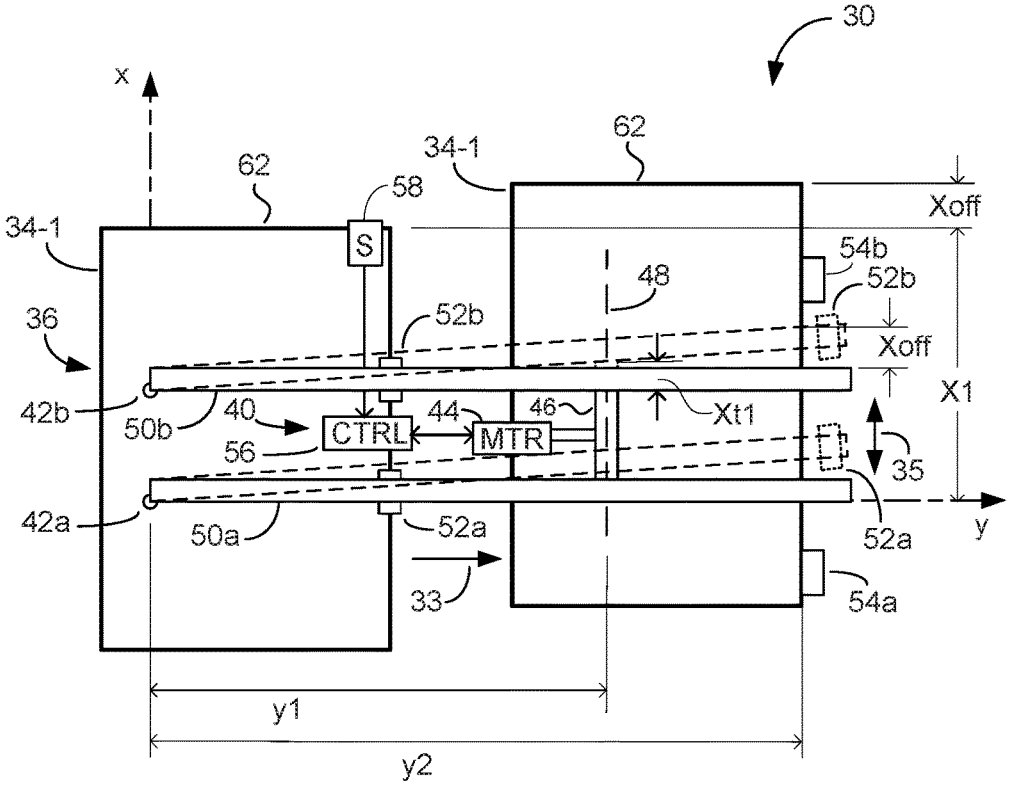
FIG. 3B is a block and schematic diagram illustrating a media registration system, according to one example.
Figure 3C:
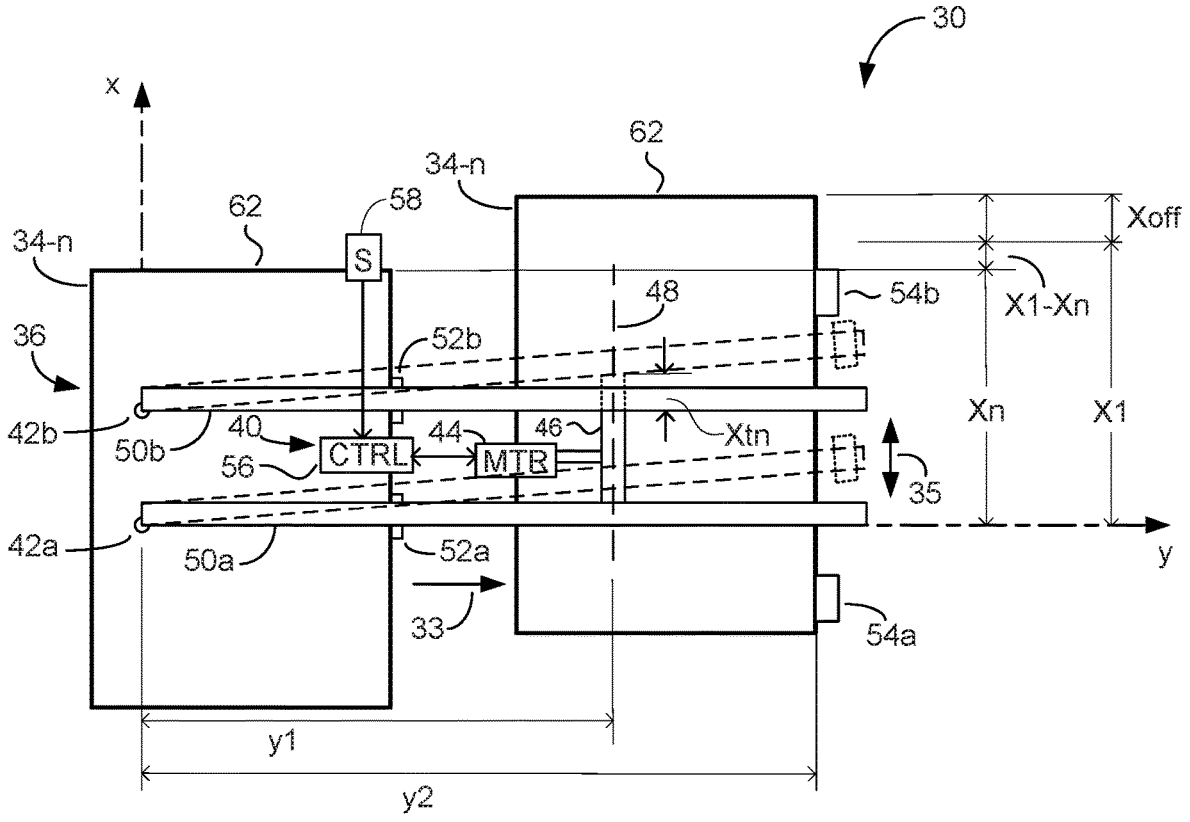
FIG. 3C is a block and schematic diagram illustrating a media registration system, according to one example.

FIGS. 3A-3C generally illustrate media registration system 30 and a method of aligning a series of sheets of imaging media 34, such as received from an image forming apparatus (not illustrated), according to one example of the present disclosure. A series of such sheets of imaging media 34 may be referred to as a "job", such as a "print job" in the case of a series of sheets of print media 34 being received from a printer, for instance.

In one example, as illustrated, translator 40 moves puller tracks 50*a* and 50*b* at registration end 38 over a range of registration distances Xr in the positive x-direction, where such range extends from a home position, where Xr is zero (such as along the y-axis, for example), to a maximum registration distance Xr in the positive x-direction (which is determined by a maximum translation distance, Xt, of translation element 46). It is noted that puller tracks 50*a* and 50*b* are illustrated as being at the home position in FIG. 3A.

FIG. 3A illustrates puller clamps 52*a* and 52*b* secured to a leading edge 60 of a first sheet of imaging media 34-1 of an imaging job, such as a print job, at intake end 36 of media registration system 30. In one example, prior to receiving a sheet of imaging media 34, including first sheet of imaging media 34-1, translator 40 moves translation element 46 to a home position so as to position puller tracks 50*a* and 50*b* at the home position (e.g., along the y-axis).

With reference to FIG. 3B, as puller clamps 52*a* and 52*b* transport first sheet 34-1 in transport direction 33 toward registration end 38, with puller tracks 50*a* and 50*b* at the home position (solid lines), sensor 58 measures a position of a rear edge 62 of sheet 34-1 in lateral direction 35 relative to a reference, such as the y-axis, for example, where rear edge 62 is parallel to transport direction 33. The measured position of rear edge 62 of the first sheet of imaging media 34-1 is indicated as X1 in FIG. 3B.

In one example, as illustrated, after measuring the lateral position of rear edge 62 of sheet 34-1, translator 40 rotates puller tracks 50*a* and 50*b* about corresponding pivot points 42*a* and 42*b* by moving translation element 46 by a translation distance Xt1 (as illustrated by the dashed lines) so that the rear edge 62 is shifted in the positive x-direction by a selected offset distance, Xoff, when the first sheet of imaging media 34-1 reaches y-registration elements 54*a* and 54*b* at registration end 38 and is released from puller clamps 52*a* and 52*b*. According to one example, in view of the above, the translation distance of translation element 46 for the first sheet of the print job, Xt1, is equal to a product of the adjustment factor, Af, and the selected offset distance, Xoff (i.e., Xt1=Af·Xoff). In one example, pivot points 42*a* and 42*b* are positioned on a same axis lateral to transport direction 33, such as along the x-axis as illustrated by FIG. 3A.

With reference to FIG. 3B, upon reaching registration end 38, rear edge 62 is at a lateral distance from the y-axis (reference) which is equal to the sum of the initial position, X1, and the selected offset distance, Xoff. In one example, since translator 40 shifts puller tracks 50*a* and 50*b* in one direction from the home position (in this case, in the positive x-direction from the y-axis), the offset distance, Xoff, is selected such that the sum of X1 (initial position) and Xoff (selected offset distance) is greater than an expected lateral position (position in the x-direction) of the rear edge of all remaining sheets of media of the print job. Since, according to such example translator 40 shifts puller tracks 50*a* and 50*b* in a positive x-direction, if a subsequent sheet 34-*n* of the print job is at a distance greater than the sum of X1 and Xoff, media registration system 30 will be unable to align the lateral edges of such sheet with initial sheet 34-1.

With reference to FIG. 3C, for each subsequent sheet of imaging media of the print job, illustrated as sheet 34-*n*, translator 40 returns puller tracks 50*a* and 50*b* to the home position (solid lines). After puller clamps 52*a* and 52*b* receive and transport each subsequent sheet 34-*n* in transport direction 33, sensor 58 measures the x-direction position of the rear edge 62 relative to the y-axis (i.e., the reference), as illustrated indicated at Xn. Translator 40 subsequently moves translation element 46 by a translation distance Xtn, such that the rear edge 62 of each subsequent sheet of imaging media 34-*n* aligns with the shifted position of the rear edge 62 of the first sheet of imaging media 34-1 (see FIG. 3B), where Xtn is equal to the product of the adjustment factor Af and the sum of the offset distance, Xoff, and a difference between the measured position, X1, of the first sheet 34-1 and the measured position, Xn, of the subsequent sheet 34-*n* (i.e., Xtn=Af·(Xoff+(X1−Xn)).

In this fashion, the lateral edges of all sheets of imaging media 34 of the print job are aligned (registered) at a distance of X1+Xoff from the y-axis (reference position). Additionally, the leading edges 60 of all sheets 34 of the print job are aligned in the y-direction by y-alignment features 54*a* and 54*b*. With all sheets of the print job aligned in both the x- and y-directions, additional operations can be performed, such as stapling, for example.

Figure 4:
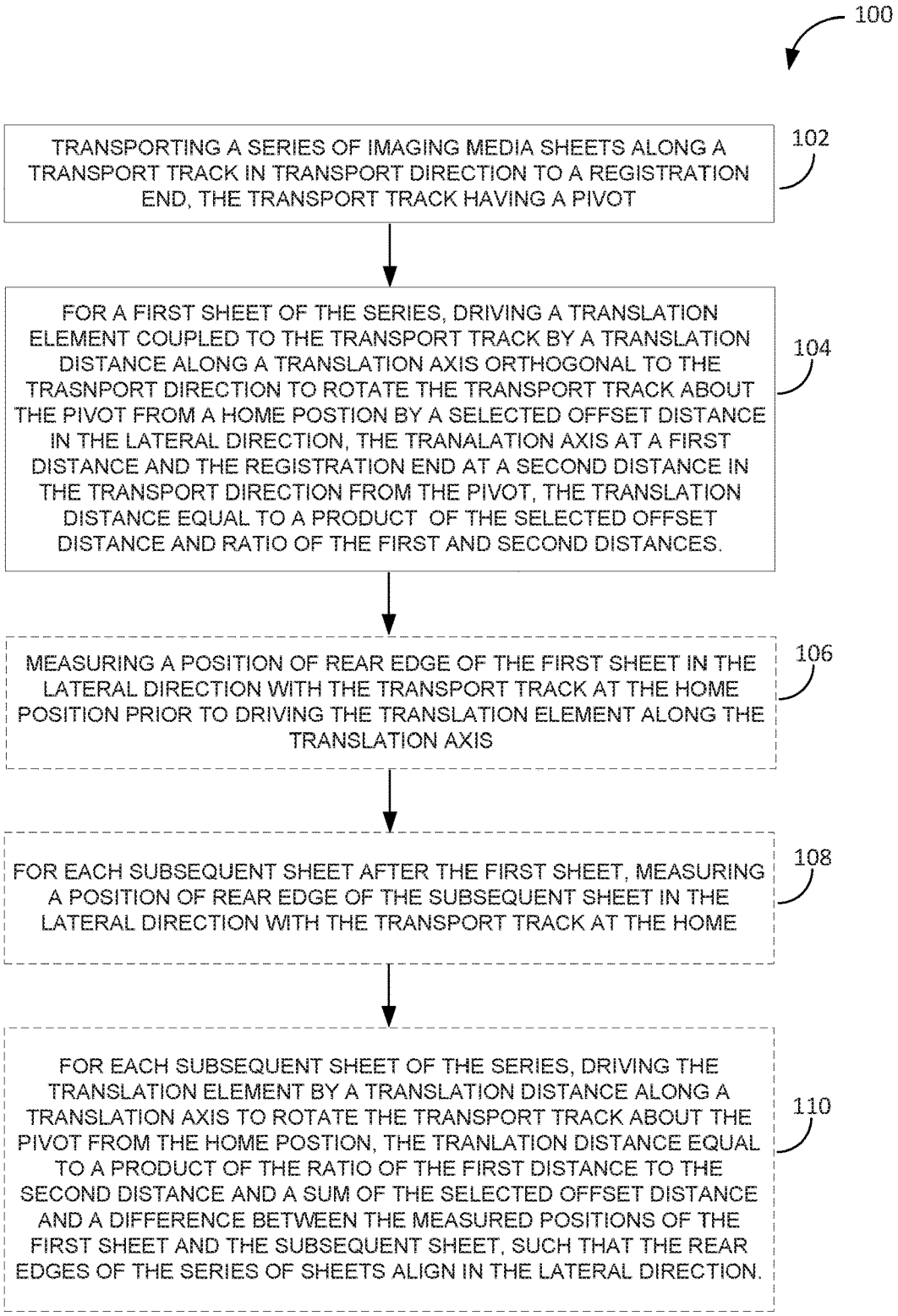
FIG. 4 is a flow diagram illustrating a method registering media, according to one example.

FIG. 4 is a flow diagram generally illustrating a method 100 of registering imaging media sheets using a media registration system including a transport track that rotates about a pivot point, such as media registration system 30 of FIG. 3A having a transport track 32 comprising puller tracks 50*a* and 50*b* having corresponding pivots 42*a* and 42*b*. At 102, such as illustrated by FIG. 3B, method includes transporting a series of imaging media sheets in a transport direction along the transport track to a registration end.

At 104, with reference to FIG. 3B, for a first sheet of the series of imaging media sheets, such as first sheet 34-1, the method includes driving a translation element operatively coupled to the transport track, such as translation element 46 coupled to puller tracks 50*a* and 50*b*, by a translation distance (Xt) along a translation axis 48 extending in a lateral direction 35 orthogonal to the transport direction 33 to rotate the transport track about the pivot and move the registration end from a home position by a selected offset distance (Xoff) in the lateral direction, the translation axis at a first distance (y1) and the registration end at a second distance (y2) in the transport direction from the pivot, the translation distance equal to a product of the selected offset distance and ratio of the first distance to the second distance.

In one example, at 106, method 100 further includes measuring a position of a rear edge of the first sheet in the lateral direction from a reference with the transport track at the home position prior to driving the translation element along the translation axis, such as measuring a rear edge 62 of sheet 34-1, as illustrated by the distance X1 in FIG. 3B.

At 108, for each subsequent sheet of the series, method 100 includes measuring a position of a rear edge of the subsequent sheet from the reference, such as measuring the distance Xn to the rear edge 62 of sheet 34-*n*, as illustrated by FIG. 3C.

At 110, for each subsequent sheet, method 100 includes driving the translation element 46 operatively coupled to the transport track by a translation distance, Xt, along the translation axis 48 to rotate the transport track about the pivot and move the registration end in the lateral direction from the home position, the translation distance equal to a product of the ratio of the first distance to the second distance and a sum of the offset distance and a difference between the measured positions of the first sheet and the subsequent sheet in the lateral direction, i.e., Xt=(y1/y2)·(Xoff+(X1−Xn), so as to align the rear edges of all sheets of the series of imaging media sheets align in the lateral direction at the registration end, such as illustrated by FIG. 3C.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A media registration system comprising:

a track to transport a series of media sheets in a transport direction to a registration end;

a translator to drive a translation element, operatively coupled to the track, along an axis extending in a lateral direction orthogonal to the transport direction to rotate the track about a pivot shaft and move the registration end in the lateral direction, the axis at a first distance and the registration end at a second distance in the transport direction from the pivot shaft, the first distance different from the second distance, and the axis being perpendicular to the pivot shaft, for a first sheet of the series of media sheets, the translator to move the registration end from a home position by a selected offset distance in the lateral direction by driving the translation element along the axis by a translation distance equal to a product of the selected offset distance and a ratio of the first distance to the second distance;

a sensor to measure, in the lateral direction with the track at the home position, a position of an edge of the first sheet and each sheet of the series of media sheets;

where for each subsequent sheet of the series of media sheets after the first sheet, the translator to:

move the registration end from a home position by driving the translation element along the axis by a translation distance equal to a product of the ratio of the first distance to the second distance and a sum of the offset distance and a difference between a measured position of the edge of the first sheet and a measured position of the edge of the subsequent sheet; and registration elements disposed at the registration end to register a leading edge of each media sheet in the transport direction.

2. The media registration system of claim 1, the translator comprising a linear actuator.

3. The media registration system of claim 1, the translation element comprising a rack and pinion system including a rack operatively coupled to the track, and the translator including a motor to drive the pinion.

4. The media registration system of claim 1, the track comprising a pair of parallel puller tracks.

5. The media registration system of claim 4, each puller track having a corresponding pivot shaft, each pivot shaft on a same axis extending in the lateral direction.

6. A method of registering imaging media sheets comprising:

transporting a series of imaging media sheets in a transport direction along a transport track to a registration end, the transport track having a pivot shaft;

for a first sheet of the series of imaging media sheets, driving a translation element operatively coupled to the transport track by a translation distance along a translation axis extending in a lateral direction orthogonal to the pivot shaft and orthogonal to the transport direction to rotate the transport track about the pivot shaft and move the registration end from a home position by a selected offset distance in the lateral direction, the translation axis at a first distance and the registration end at a second distance in the transport direction from the pivot shaft, the first distance different from the second distance, the translation distance equal to a product of the selected offset distance and ratio of the first distance to the second distance;

measuring a position of a rear edge of the first sheet in the lateral direction from a reference with the transport track at the home position prior to driving the translation element along the translation axis, the rear edge parallel to the transport direction;

measuring a position of a rear edge of a subsequent sheet in the lateral direction from the reference with the transport track at the home position, the rear edge parallel to the transport direction;

driving the translation element operatively coupled to the transport track by a translation distance along the translation axis to rotate the transport track about the pivot shaft and move the registration end in the lateral direction from the home position, the translation distance equal to a product of the ratio of the first distance to the second distance and a sum of the offset distance and a difference between the measured positions of the first sheet and the subsequent sheet in the lateral direction, such that the rear edge of the subsequent sheet aligns with the series of imaging media sheets in the lateral direction at the registration end; and registering a leading edge of each sheet of the series of imaging media sheets in the transport direction at the registration end.

7. The method of claim 6, where transporting each sheet of imaging media along a transport track includes transporting each sheet of imaging media along a transport track comprising a pair of parallel puller tracks with puller clamps driven along the parallel puller tracks.

8. The method of claim 6, including moving the leading edge against registration elements at the registration end to register the leading edge.

* * * * *